United States Patent [19]

Goncalves

[11] Patent Number: 4,848,946

[45] Date of Patent: Jul. 18, 1989

[54] DISPENSING CONTAINER INCLUDING A BRUSH-TYPE APPLICATOR

[75] Inventor: Antonin Goncalves, Groslay, France

[73] Assignee: L'Oreal, Paris, France

[21] Appl. No.: 151,529

[22] Filed: Feb. 2, 1988

[30] Foreign Application Priority Data

Feb. 3, 1987 [FR] France ..... 87 01249

[51] Int. Cl.[4] ..... A46B 11/00; A46B 11/02

[52] U.S. Cl. ..... 401/131; 206/229; 401/123; 401/124; 401/126; 401/183; 401/190; 401/269; 401/288

[58] Field of Search ..... 220/379; 206/229, 230; 401/123, 124, 125, 126, 190, 131, 269, 288, 183

[56] References Cited

U.S. PATENT DOCUMENTS

| | | | |
|---|---|---|---|
| 438,898 | 10/1890 | Rodiger | 220/379 |
| 563,645 | 7/1896 | Bitting | 401/131 X |
| 3,137,885 | 6/1964 | Hulsh | 401/190 |
| 3,272,323 | 9/1966 | Ewry | 206/229 |
| 3,732,591 | 5/1973 | Gach | 401/190 X |
| 3,784,063 | 1/1974 | Otis et al. | 401/190 X |
| 4,013,369 | 3/1977 | Turek | 401/190 X |
| 4,384,645 | 5/1983 | Manfredi | 206/229 |
| 4,636,102 | 1/1987 | Drake | 401/190 |

FOREIGN PATENT DOCUMENTS

| | | | |
|---|---|---|---|
| 2550427 | 2/1985 | France . | |
| 2592004 | 6/1987 | France . | |
| 1101918 | 2/1968 | United Kingdom | 206/229 |
| 1255666 | 12/1971 | United Kingdom | 401/190 |
| 2143725 | 2/1985 | United Kingdom . | |

*Primary Examiner*—Steven A. Bratlie

*Attorney, Agent, or Firm*—Cushman, Darby & Cushman

[57] ABSTRACT

The container is provided with an outlet opening associated with a dispensing head (5) including an ejection duct (21–26) disposed in the axis of the outlet opening of the container, and a nozzle (28) forming an angle with the ejection duct, an applicator (8) being disposed at the free end of the nozzle (28). This applicator (8) includes on the one hand a cylindrical sleeve (31) cooperating with the free end of the nozzle (28) and on the other hand a base plate (29) joined by the cylindrical sleeve and which includes bristles (30) on its face opposite the cylindrical sleeve (31). The projection (7), a movable part of the dispensing head, includes on its top wall a device (17) for retaining the cylindrical sleeve (31) in a position in which its axis is substantially parallel to that of the outlet opening, so that a guard cap can be put into place on the dispensing zone of the container (1).

6 Claims, 2 Drawing Sheets

DISPENSING CONTAINER INCLUDING A BRUSH-TYPE APPLICATOR

FIELD OF THE INVENTION

The present invention relates to a container for packaging a product and dispensing it in a controlled manner, the container including an applicator, particularly of the brush type. The container may or may not be pressurized, of the type known as an aerosol can.

BACKGROUND OF THE INVENTION

U.S. Pat. No. 4,533,273 relates to a pressurized container of the aerosol can type including a dispensing valve with which a user, by pressing on a pushbutton associated with the valve, can cause the ejection of the product contained. The container includes an applicator device comprising a cap and a brush mounted on the cap. The cap includes a cylindrical skirt, which on its lower portion is provided with a groove capable of cooperating with a bead of the container in order to attach them to one another. The upper end of this skirt is open and is inclined with respect to the axis of the container. An ejection tube, which is located inside the volume defined by the cylindrical skirt, covers the valve tube with its lower end, while its upper end is obliquely extended and protrudes slightly beyond the upper opening of the skirt. The ejection tube includes a pushbutton connected to the cylindrical skirt, which at this level has an opening with which the user can press with a finger on the pushbutton. The brush, which is held on the open end of the cylindrical skirt, includes a base plate, on the outer face of which bristles are disposed; on its other face, it includes a cylindrical sleeve, which on the one hand covers the upper end of the ejection tube and on the other joins an opening made in this base plate. By pressing on the pushbutton, the user exerts pressure on the valve of the container, which makes it possible to dispense a given quantity of the product onto the brush. According to this patent, the product is preferably a detergent.

An apparatus of this kind has the disadvantage in particular that it is relatively expensive to make and that it cannot be covered with a guard cap.

SUMMARY OF THE INVENTION

The object of the present invention is in particular to furnish a container that includes an applicator of simple construction that is adaptable for all kinds of containers.

Another object of the invention is to furnish a container of this kind capable of including a traditional cap.

These, as well as other objects which will be apparent from the following, are embodied in a container for packaging a product and dispensing it in a controlled manner, provided with an outlet opening associated with a dispensing head that includes a cylindrical skirt firmly attached to the container and connected to a bottom into which an ejection duct discharges, and ejection duct being disposed substantially in the extension and in the axis of the outlet opening and the bottom being topped with a projection and including a nozzle substantially normal to the projection and extending the ejection duct with which it forms an angle, and having an applicator disposed at the free end of the nozzle and including a cylindrical sleeve which cooperates with the free end of the nozzle. The applicator includes a base plate joined by the cylindrical sleeve and which includes bristles in its face opposite the cylindrical sleeve, the bristles being disposed about the zone adjoined by the sleeve, and that the projection includes on its top wall a device for retaining the cylindrical sleeve in a position where its axis is substantially parallel to that of the outlet opening, so that a guard cap can be placed over the dispensing zone of the container. Advantageously, the retaining device cooperating with the cylindrical sleeve is a recess or a plug. The applicator can be made of flexible plastic material, such as an elastomeric copolymer of ethylene and vinyl acetate. Preferably, the base plate is circular, and the cylindrical sleeve substantially joins its central zone.

In a preferred embodiment of the invention, the container is pressurized, in the manner of an aerosol can; a dispensing valve is disposed on the outlet opening, and the dispensing head includes a pushbutton cooperating with the valve, causing the product to be ejected via the ejection duct and the nozzle.

The ensuing description is made solely by way of non-limiting example and is to be taken in conjunction with the drawings.

DESCRIPTION OF THE PREFERRED EMBODIMENT

Figure 2:
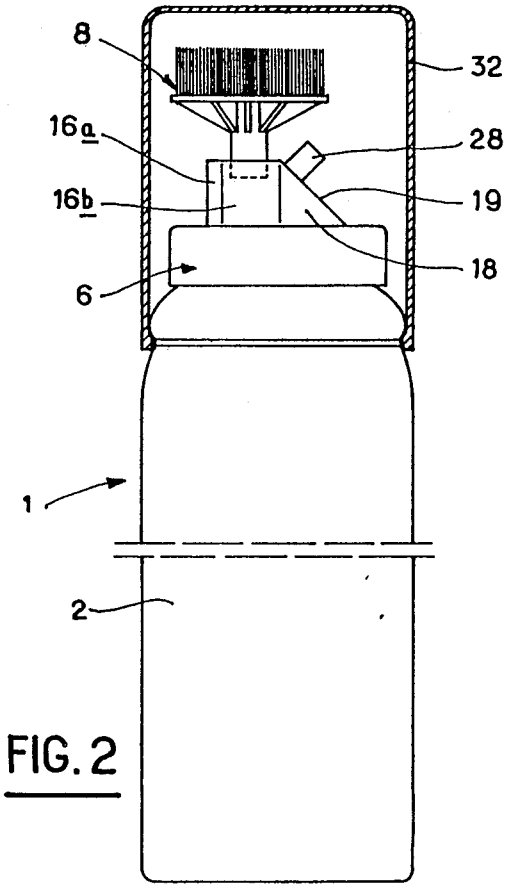
FIG. 2 is an elevational view of the container of FIG. 1, in which the applicator is in the storage position on the dispensing head, and a guard cap, seen in section, covers the dispensing head.
Figure 1:
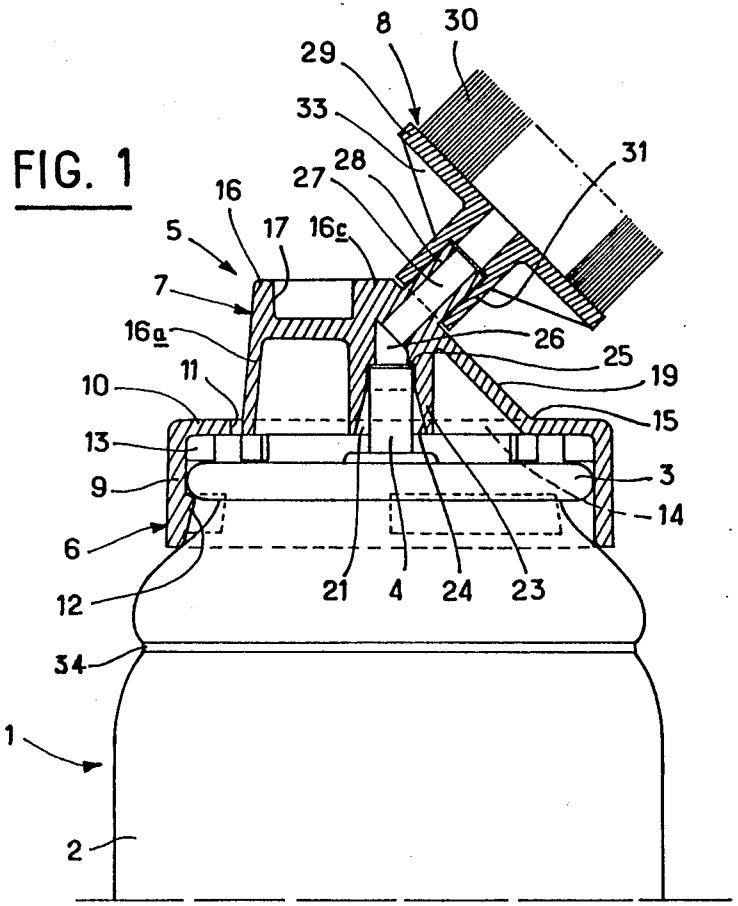
FIG. 1 is a fragmentary front view of a pressurized container according to the invention, of the aerosol can type, and including a dispensing head provided with an applicator, the head being shown in an axial section.

In FIG. 1, reference numeral 1 generally identifies a pressurized container of the aerosol can type, used for packaging a product that is to be dispensed in the form of a mousse or an aerosol at the outlet of the container 1.

The container includes a body 2, having a cylindrical side wall on the upper outer edge of which a valve holder collar 3 is fixed by means of a crimped connection in the central zone of this valve holder collar 3 is a valve provided with a protruding outlet tube 4. If the outlet tube 4 of the valve is pressed, the contents of the container are released into the open air and are hence projected outside the container under the influence of the propellant gas inside the container, and simultaneously producing mousse or an aerosol, depending on the products comprising the liquid phase.

A dispensing head 5 comprising a fixed portion 6 and a movable portion 7, which is provided with an applicator 8, is mounted on to the body 2.

The fixed portion 6 of the dispensing head 5 comprises a peripheral cylindrical skirt 9 connected to a bottom 10 including a central opening 11. When the dispensing head 5 is in the assembled position on the body 2, the bottom 10 overlies the upper peripheral edge of the valve holder collar 3. On the inside, in the vicinity of its free edge, the skirt 9 has an interrupted annular retaining ring 12, which when the head 5 is in the assembled position snaps into place on the inside of the peripheral throat produced by the operation of crimping of the valve holder collar 3 onto the lateral wall of the body 2 of the container 1. The fixed portion 6 of the dispensing head 5 includes a plurality of radial fins 13 connected to the skirt 9 and to the bottom 10, these fins 13 being supported on the upper peripheral edge of the valve holder collar 3 once the fixation of the head 5 on the body 2 has been assured.

The movable portion 7, or projection, of the dispensing head 5 comprises a pedestal 14 of disk shape having a diameter slightly less than that of the opening 11; this pedestal 14 is linked to the inside edge of the bottom 10 with a film hinge 15. On its outside, opposite the film hinge 15, the pedestal 14 has a pushbutton 16 comprising a protuberance defined by a frustoconical outside lateral wall 16*a*, two substantially radial lateral walls 16*b* and an upper wall 16*c* ; by pressing on this upper wall 16*c* , the user exerts pressure upon the pushbutton 16 in order to dispense the product contained in the container 1. This upper wall 16*c* includes a circular recess 17.

The walls 16*b* are extended via walls 18 that are parallel to one another, the height of which decreases progressively up to the line of the film hinge 15. These walls 18 are joined together by an oblique rectangular wall 19, the base of which is determined by the film hinge 15.

In a projection at its lower face, the wall 16*c* has a cylindrical shaft 23, the lower edge 24 of which is chamfered and which defines an ejection duct 21, this duct is extended, following an inside annular shoulder 25, with a portion of lesser diameter 26 into which a duct 27 defined by a nozzle 28 discharges. The duct 27 passes through the wall 19 in its upper portion, and the nozzle 28 projects to the outside with respect to the wall 19. The applicator 8 comprises a base plate 29 one face of which, turned to the outside, includes bristles 30, while its other face, opposite that carrying the bristles 30, is extended by means of a cylindrical sleeve 31. The inside diameter of this cylindrical sleeve is substantially equal to the outside diameter of the nozzle 28, such that the cylindrical sleeve 31 can be fitted onto the nozzle 28. The cylindrical sleeve 31 joins the base plate 29 substantially at the center thereof.

The base plate 29, of circular shape, acts as a support for a multitude of bristles, which have a substantially square cross section. This applicator is molded entirely from an elastomeric copolymer of ethylene and vinyl acetate. Fins 33 are provided for supporting the base plate 29; they are supported on the cylindrical sleeve 31.

As already noted, by pressing upon the pushbutton 16, action is exerted upon the protruding rod 4 of the valve such that the product contained in the container 1 is ejected into the ejection duct 21 and then into the duct 27 of the nozzle 28 and consequently to the base of the bristles 30 of the applicator 8.

Since the nozzle 28 is substantially normal to the wall 19 of the dispensing head 5, this nozzle 28 forms an angle with the ejection duct 21–26, located in the axis of the container 1.

In the storage position, the applicator 8 is placed such that its cylindrical sleeve 31 assumes a position in the recess 17 of the upper wall 16*c* of the pushbutton 16, in such a way that the dispensing head can be covered with guard cap 32. In this manner, the axis of the applicator 8 is parallel to the axis of the container 1, and the applicator 8 does not project beyond the container 1 at any point, which makes it possible for it to be covered with a guard cap 32, the base of which cooperates with a groove 34 provided in the body 2 of the container 1.

Figure 5:
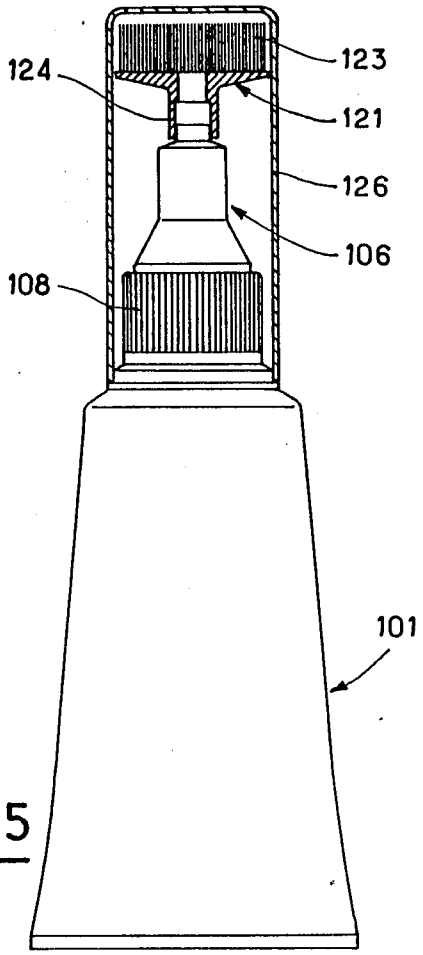
FIG. 5 is a view of the container of FIG. 3 in which the applicator, seen in section, is in the storage position on the dispensing head and a cap, seen in section, covers the dispensing head.
Figure 4:
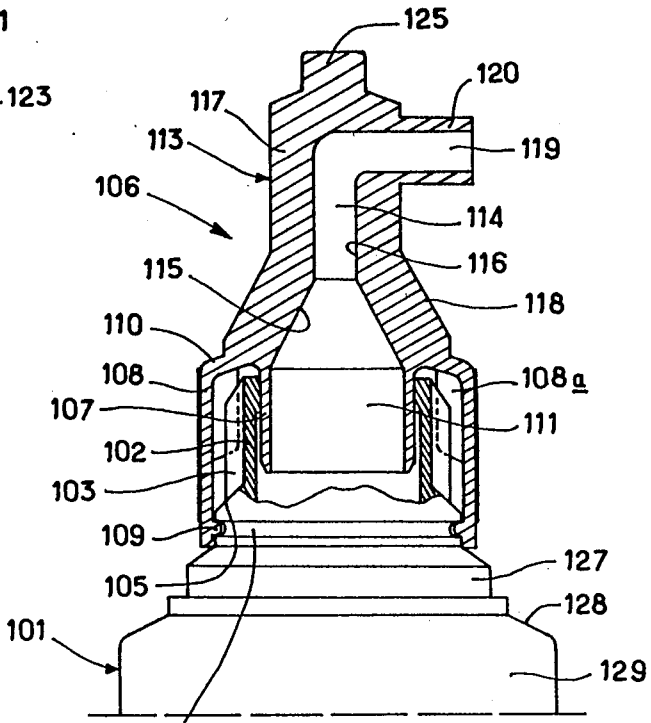
FIG. 4 is a sectional view of the dispensing head mounted on the container of FIG. 3.
Figure 3:
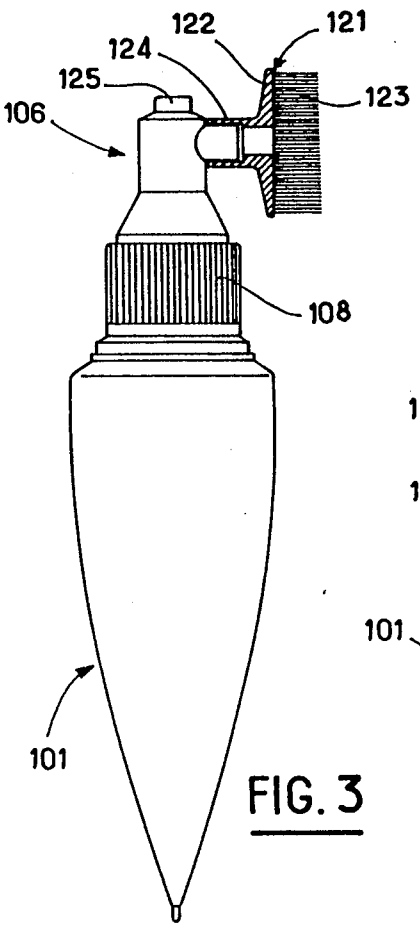
FIG. 3 is an elevational view of a non-pressurized container according to the invention, which includes a dispensing head provided with an applicator seen in section.

Another embodiment of the present invention is shown in FIGS. 3–5 and relates to a non-pressurized container in the manner of a non-rigid, squeezable tube.

In its upper portion, this non-rigid tube 101 includes a ring 102 with fluting 103 on its outside. The ring 102 defines the neck of the tube and is integrally molded with it. The lower portion of the ring 102 is provided with a throat 104, which in turn is connected to the fluting 103 via an inclined wall 105.

In its lower portion, the dispensing head 106 has two concentric skirts: a sealing skirt 107, which presses against the inside wall of the ring 102, and a locking skirt 108 which in its lower portion includes a bead 109 cooperating with the throat 104. The two skirts 107 and 108 are connected to a bottom 110 into which the axial duct 111 defined by the skirt 107 discharges. The locking skirt 108 has twist-preventing fins 108a on its inside, which upon assembly charge the fluting 103 of the ring 102.

The dispensing head 106 includes a projection 113 atop the bottom 110, and the projection includes an axial duct 114 of small diameter that extends the axial conduit 111. A frustoconical wall 115 connects the wall 116 of the duct 114 of smaller diameter to the cylindrical skirt 107. The ducts 111 and 114 comprise the ejection duct. The projection 113 is defined in its upper portion, including the axial duct 114, by a cylindrical wall 117 that is connected to the bottom 110 by an oblique wall 118.

A duct 119 defined by a nozzle 120 which extends perpendicular to the wall 117 of the projection 113 discharges into the duct 114.

The applicator 121 comprises a base plate 122 of circular shape including bristles 123 on one face, called the outer face, and a cylindrical sleeve 124, on its other face, that substantially joins the center of the base plate 122.

The cylindrical sleeve 124 has an inside diameter slightly greater than the outside diameter of the nozzle 120 to permit the fitting on of the applicator 121 onto this nozzle 120, with sufficient friction to assure the retention of the applicator 121 on the dispensing head 106.

The dispensing head 106 has a plug 125 on its top, on which the cylindrical sleeve 124 of the applicator 121 can be fitted if it is desired to cover the dispensing head 106 with as guard cap 126, the lower portion of which cooperates with a shoulder 127 located on the oblique wall 128 that connects the body 129 of the container 101 to the base of the ring 102.

What is claimed is:

1. A container for packaging a product and dispensing a product in a controlled manner, said container being provided with an outlet opening having an axis and associated with a dispensing head, said dispensing head including a cylindrical skirt firmly attached to said container, said head having a bottom and an ejection duct extending generally transversely from said bottom and being in alignment with said outlet opening of said container, said bottom carrying a projection having a nozzle extending therefrom, said nozzle being in flow communication with said ejection duct and intercepting said ejection duct at a selected angle, said nozzle having a free end and an applicator having a cylindrical sleeve disposed on said free end of said nozzle, said cylindrical sleeve having an axis, the improvement comprising, said applicator including a base plate having on one side a face carrying bristles and being connected to said cylindrical sleeve on the opposite side thereof, said base plate having an opening communicating with said cylindrical sleeve with said bristles being disposed about said opening on said base plate, said projection having a top wall including means for retaining said cylindrical sleeve in a position where the axis of said cylindrical sleeve is substantially parallel to said axis of said outlet opening so that, when said cylindrical sleeve is disposed in said means for retaining, a guard cap is disposable over said dispensing head.

2. The container as claimed in claim 1, wherein said retaining means comprises a recess formed in said top wall of said projection.

3. The container as claimed in claim 1 or 2, wherein said applicator is made of flexible plastic material.

4. The container as claimed in claim 1 or 2, wherein said base plate is circular, and has a central axis and said cylindrical sleeve is joined to said base plate about said central axis.

5. The container as claimed in claim 1 or 2, wherein said container includes a dispensing valve connected to said outlet opening for controlling dispensing of a fluid under pressure, said dispensing head including a push button for engaging said dispensing valve in order to effect dispensing of the product through said ejection duct and nozzle.

6. The container as claimed in claim 3, wherein said plastic material is an elastomeric copolymer of ethylene and vinyl acetate.

* * * * *